United States Patent [19]

Neuhierl

[11] 4,148,450

[45] Apr. 10, 1979

[54] MODEL AIRCRAFT CONSTRUCTION

[76] Inventor: Hermann Neuhierl, Waldstrasse 36, 8510 Fürth, Bayern, Fed. Rep. of Germany

[21] Appl. No.: 830,316

[22] Filed: Sep. 2, 1977

Related U.S. Application Data

[63] Continuation of Ser. No. 682,794, May 3, 1976, abandoned.

[30] Foreign Application Priority Data

May 6, 1975 [DE] Fed. Rep. of Germany ..... 2520167
Mar. 18, 1976 [DE] Fed. Rep. of Germany ..... 2611555

[51] Int. Cl.[2] ..... B64C 3/00; A63H 27/02

[52] U.S. Cl. ..... 244/124; 46/76 R; 244/45 R; 244/117 R; 244/120

[58] Field of Search ..... 244/130, 124, 120, 35 R, 244/45 R, 119, 133, 117 R, 123; 46/76 R, 76 A, 78, 79, 80

[56] References Cited

U.S. PATENT DOCUMENTS 1,605,045 11/1926 Mader ..... 244/124
2,417,189 3/1947 Cornelius ..... 244/35 R

FOREIGN PATENT DOCUMENTS 487996 12/1929 Fed. Rep. of Germany ..... 244/117 R

*Primary Examiner*—Trygve M. Blix
*Assistant Examiner*—Charles E. Frankfort
*Attorney, Agent, or Firm*—Haseltine, Lake & Waters

[57] ABSTRACT

A model aircraft of the glider or motor-driven type can be provided with one or more different types of wing according to requirements by interposition between the respective pairs of wings and the fuselage of intermediate members adapted on the one hand to the fuselage of the aeroplane and on the other hand to the associated wings and ensuring an aerodynamically smooth transition from the fuselage to the wing. The fuselage can have a pair of lateral surfaces adapted in accordance with the cross-section of one specific wing construction so that intermediate members are only required if it is desired to employ wings differing from those having such a cross-section.

14 Claims, 11 Drawing Figures

MODEL AIRCRAFT CONSTRUCTION

This is a continuation of application Ser. No. 682,794 filed May 3, 1976 now abandoned.

FIELD OF THE INVENTION

This invention relates to model aeroplanes of the glider or motor-driven type which comprise, scaled down from the dimensions of a full size aeroplane, a fuselage and a pair of wings fitted laterally one on each side of the fuselage by releasable fixing means. This invention also relates to assemblages of parts such that different pairs of wings can be satisfactorily fitted to a single model aeroplane fuselage.

BACKGROUND OF THE INVENTION

With model aircraft, the wings are fitted on the fuselage, either on the upper side thereof (high-wing monoplanes), on the under side thereof (low-wing monoplanes) or at an intermediate position on the fuselage (mid-wing monoplanes); model gliders generally possess this last type of wing arrangement. With mid-wing monoplanes, it is necessary to reduce the so-called interference resistance at the transition between the wings and the fuselage in an aerodynamically favourable manner. If the transition between the wings and the fuselage is achieved by shaping of the fuselage in the region in which the wings are to be affixed thereto by forming laterally on the fuselage a connecting surface or fairing corresponding to the cross-sectional profile of the wing, this means that, when the wings used are to be detachable, this being required with model aircraft for the purpose of easier transport, only a single quite specific cross-sectional profile of wing can be used.

With model aircraft, however, it is becoming increasingly desirable to be able to use interchangeable wings of different cross-sectional form and thus flying properties with a single fuselage. Weather conditions, in particular wind conditions, always vary to a considerable degree, and this means that the controller of the model aircraft, having to consider whether to achieve soaring flights, thermic flights or towing flights, might wish to be able to choose the wings most suited to achievement of a particular type of flight. However, this provision of wing variability has not hitherto been possible more particularly with mid-wing monoplanes because of the aforesaid need to provide a transition fairing on the fuselage designed for a single wing profile.

OBJECTS OF THE INVENTION

It is an object of this invention to provide a means whereby pairs of wings of different cross-section may be employed with a single model aeroplane fuselage.

It is a further object of this invention to provide a model aeroplane whose wings are releasably fitted directly to the fuselage, but which can be replaced readily by wings of alternative cross-section.

SUMMARY OF THE INVENTION

According to one aspect of this invention, there is provided a model aeroplane of the glider or motor-driven type which comprises, scaled down from the dimensions of a full size aeroplane, a fuselage, a pair of wings fitted laterally, one on each side of the fuselage by releasable fixing means, and an intermediate member intermediate the end of each wing which is adjacent the fuselage and the fuselage, which intermediate member has outer surfaces having contours which provide an aerodynamically smooth transition from the fuselage to the wings, the intermediate member being defined on the side thereof adjacent the wing by an end surface which corresponds in size and shape to the cross-sectional form of the wing and being defined on the side thereof adjacent the fuselage by an end surface which corresponds in its contours to the contours of the fuselage.

According to a second aspect of the invention, there is provided an assemblage of parts for use in the construction of model aeroplanes of the glider or motor-driven type, which comprises, scaled down from the dimensions of the respective parts of a full-size aeroplane:

a fuselage, a plurality of pairs of wings having different aerodynamic characteristics for fitting laterally one of each pair of wings on each side of the fuselage, releasable fixing means for fixing the pairs of wings to the fuselage, and associated with each pair of wings, a pair of intermediate members for fitting intermediate the associated wings and the fuselage and having outer surfaces whose contours are such that an aerodynamically smooth transition is provided from the fuselage to the associated wings, the intermediate members being defined on the side thereof adjacent the wings, in use, by end surfaces which correspond in size and shape to the cross-section of the associated wings and being defined on the side thereof adjacent the fuselage, in use, by an end surface which corresponds in its contours to the contours of the fuselage and is the same for each pair of intermediate members.

By the provision of the intermediate members which provide the required aerodynamically smooth condition between the fuselage and the associated wings, it is possible for wings of different cross-sectional profile to be fitted on a fuselage. Provision will generally be made in the intermediate members for the through-passage of means for fixing the wings to the fuselage so that the intermediate members are simultaneously clamped between the wings and the fuselage. For a particular aircraft fuselage, it is only necessary for a suitable intermediate member to be made available for each wing cross-section; the end of the intermediate member which is adjacent the fuselage will always be the same, although the opposite end will be shaped in accordance with the cross-section of the associated wing.

The intermediate member may comprise a skin over a stiffening strut structure in which the struts are so disposed with respect to each other that the fixing means are able to pass through the intermediate members from the fuselage to the wings. The skin is then preferably formed of an elastomeric material whereby the intermediate member is pressed with a slight pretension against the fuselage. Alternatively, the intermediate member may be formed as a self-supporting body of an elastomeric material. The body may either be hollow to allow through-passage of fixing means as aforesaid or may be basically solid, but provided with through-passages for such fixing means. A self-supporting intermediate member is also preferably formed of an elastomeric material for the aforesaid purpose.

If the fuselage is provided with paired lateral surface corresponding to the cross-sectional form of one particular wing, it is possible to dispense with the use of intermediate members for that one type of wing which can then be fitted directly to the fuselage. If alternative wing forms are to be used, then the requisite intermediate member will be required. In this case, the intermediate members will possess one end surface corresponding in size and shape to that of the lateral surfaces of the fuselage and one end surface corresponding in like manner to one specific form of wing cross-section differing from that of the wing which can be fitted directly to the fuselage.

BRIEF DESCRIPTION OF THE DRAWINGS

For a better understanding of the invention and to show how the same can be carried into effect, reference will now be made, by way of example only, to the accompanying drawings, wherein.

DETAILED DESCRIPTION OF THE PREFERRED EMBODIMENT

Figure 1:
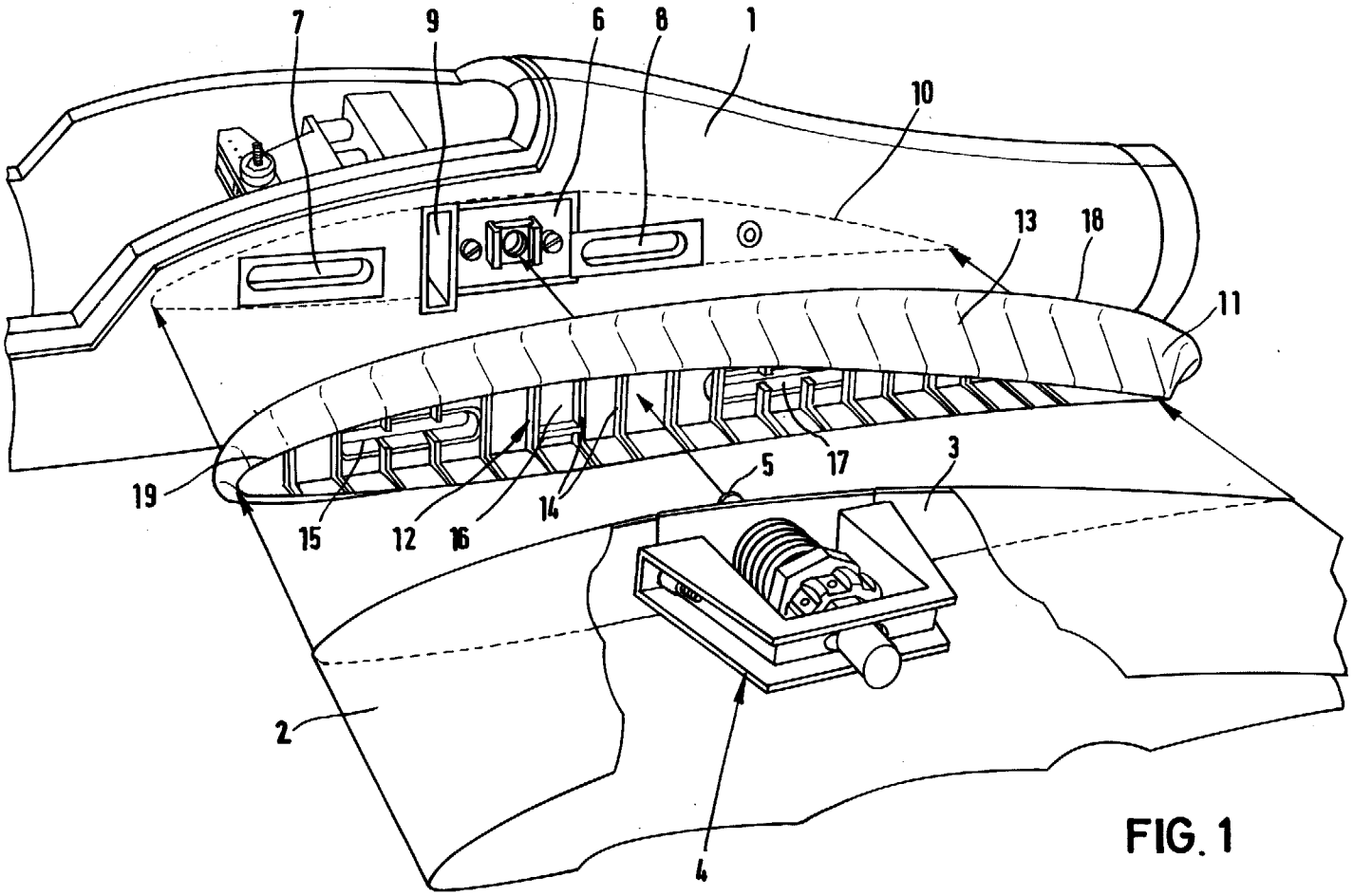
FIG. 1 is a part sectional exploded view of a part of a fuselage and of a wing to be fitted thereon using an intermediate member.
Figures 2, 3:
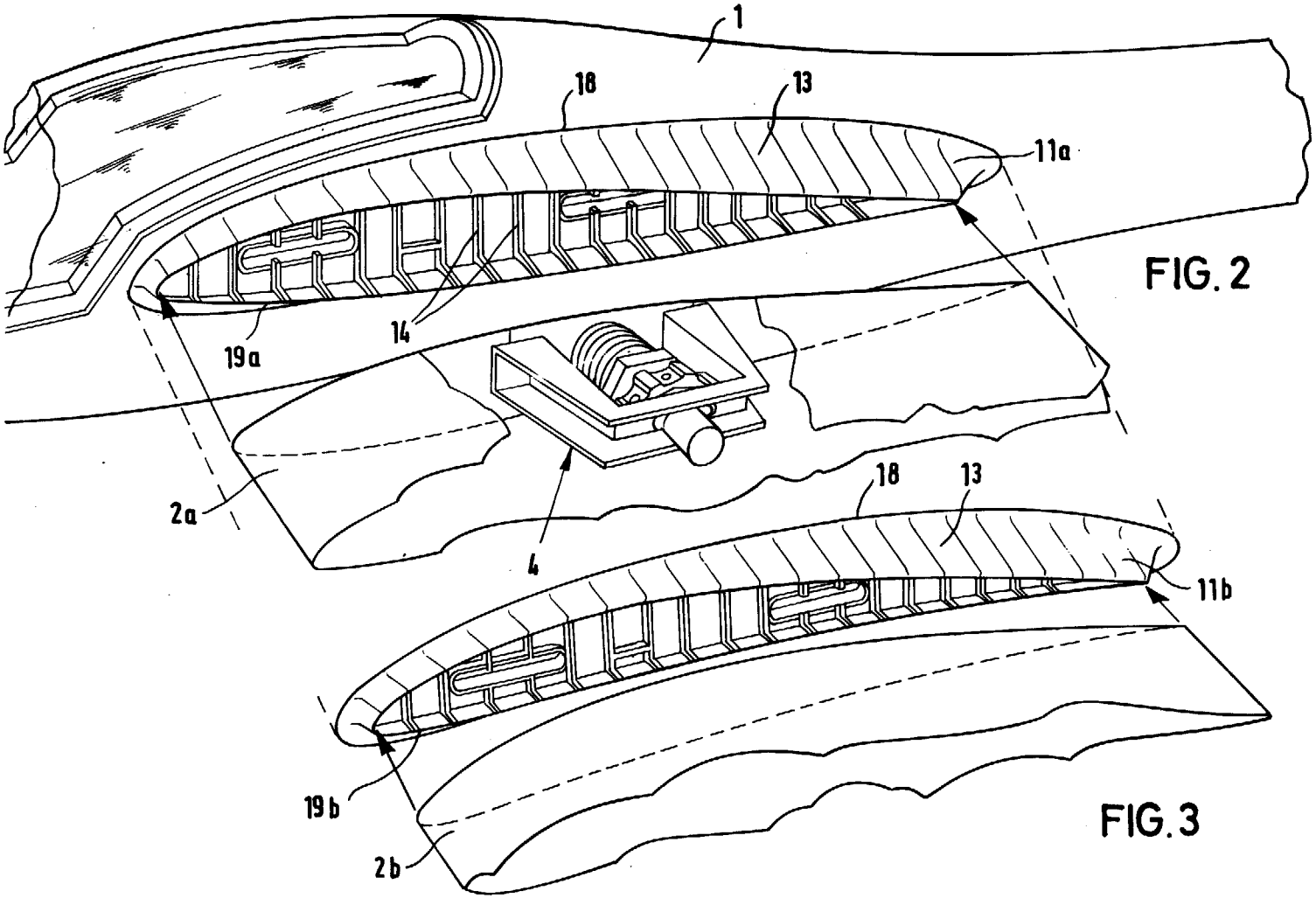
FIGS. 2 and 3 are views of the type shown in FIG. 1 of wings which are to be attached to the fuselage and which have other cross-sectional profiles and correspondingly adapted intermediate members.
Figure 4:
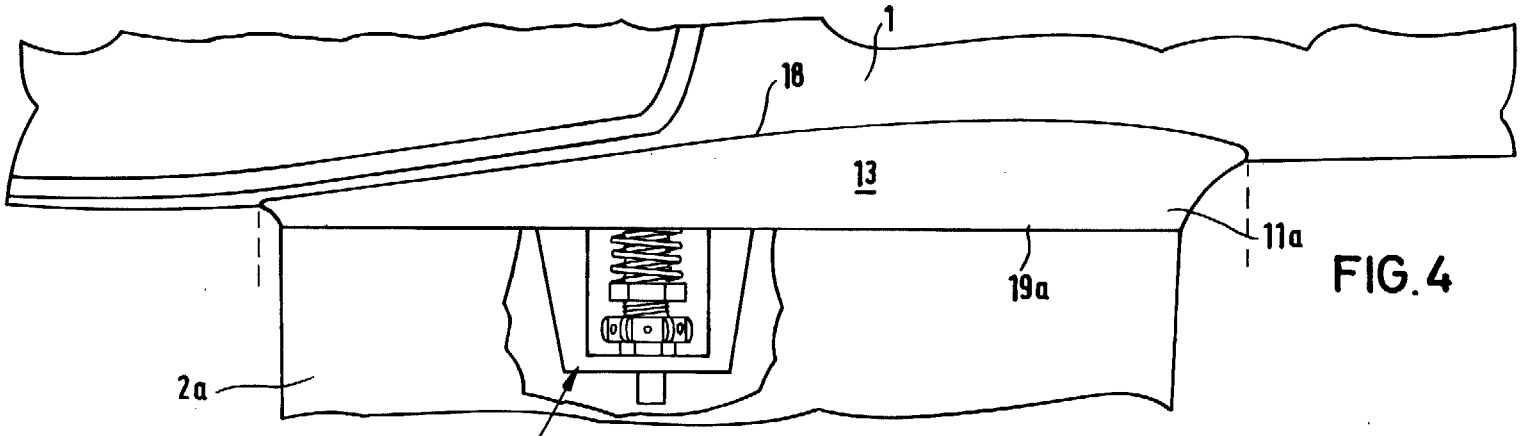
FIGS. 4 and 5 are partial plan views of wings of different cross-section fitted laterally on a model plane fuselage.
Figure 5:
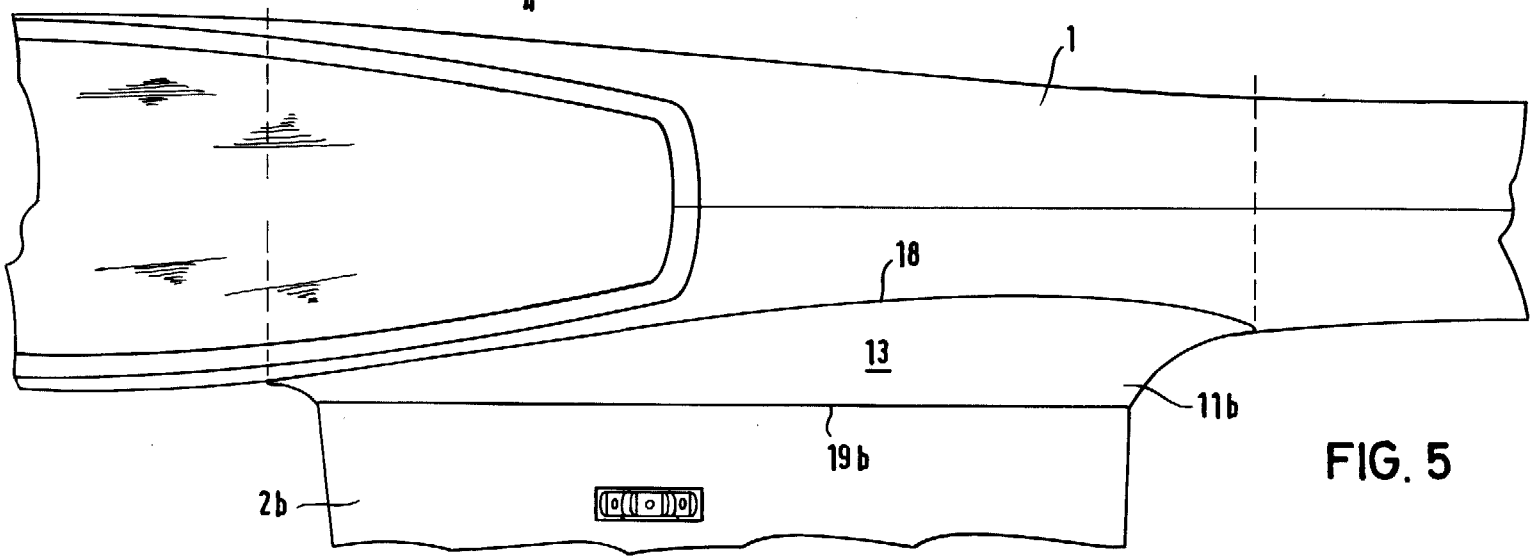

Referring to FIGS. 1 to 3, a wing is to be fixed on the fuselage 1 of a model aircraft, a corresponding wing 2 being made available for fixing in like manner on the opposite side of the fuselage 1, but not being shown. The fixing is achieved by means of a fixing device 4 which is disposed in the end 3 of the wing and which is made visible by breaking away part of the wing skin. The fixing device is not fully described herein, since it does not form part of the invention. A screw 5 of the fixing device 4 is screwed or engaged in a suitable holding device 6 in the fuselage 1. Other recesses 7,8,9 are provided in the fuselage, into which holding pins (not shown) can be inserted. These pins project into openings (not shown) in the end of the wing.

Arranged inside the joint or gap which is formed when the end 3 of the wing is fixed by means of the fixing device 4 on that surface which is indicated by a chain-dotted line 10 on the fuselage 1, or is facing said surface, is an intermediate member 11. This intermediate member 11 comprises a middle part 12 which lies within the joint or gap and which is housed within a skin 13. The middle part 12 consists of a plurality of struts 14 which hold the skin 13 in the required aerodynamically favourable shape. Openings 15,16,17 are formed in the strut arrangement for through-passage of the fixing device 4 or its associated screw 5 and holding pins as aforesaid which are not shown and which project into the opeing 7 to 9 of the fuselage. The skin 13 of the intermediate member 11 is of an aerodynamically favourable shape so as to avoid the setting up of interference resistance between the fuselage 1 and wing 2 when the plane is in flight and is defined by an edge 18 adapted to the contours of the fuselage and an edge 19 adapted to the cross-sectional form of the wing 2.

Figure 6:
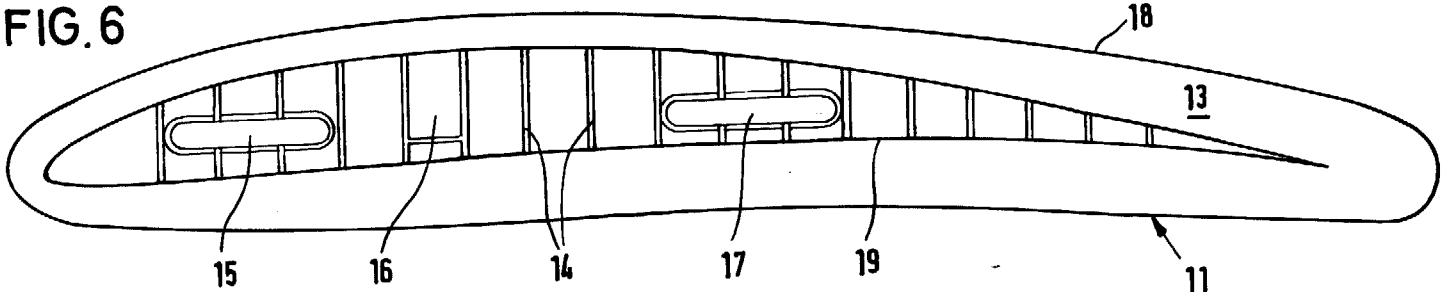
FIGS. 6 to 8 are side elevations of different intermediate members for the connection of wings of different cross-section to a model plane fuselage.
Figure 7:
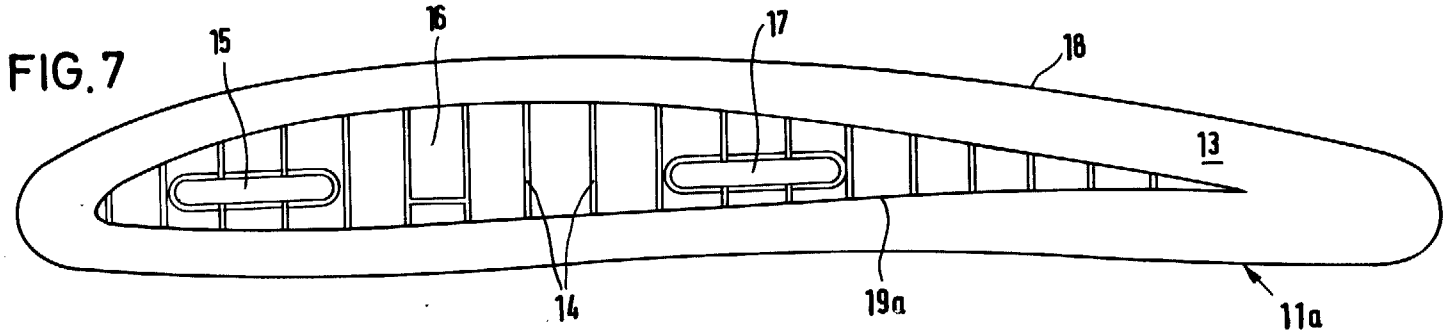
Figure 8:
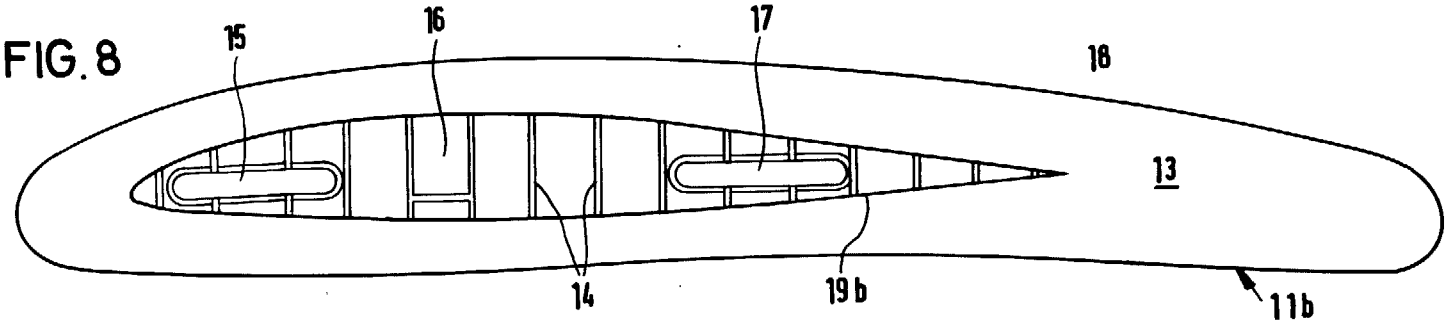

Referring next to FIGS. 2 to 5 and to FIGS. 6 to 8, it can be seen that the diffferent forms of intermediate member bearing the reference numerals 11,11*a* and 11*b*, as the case may be, and intended for use with the same model aircraft fuselage possess an edge 18 which is to abut the fuselage and always possesses the same contours, whereas the edge 19 on the wing side is always adapted to the cross-sectional form of the wing 2 which is to be fitted. In FIGS. 2 to 5 and 6 to 8, therefore, the reference numeral 18 is always employed for the edge which abuts the fuselage, whereas the edge 19 is indicated as 19, 19*a* or 19*b*, depending on its constructional form.

The intermediate members 11,11*a*,11*b* are preferably injection moulded from high-quality synthetic plastics material which is preferably elastomeric. If the controller of the model aircraft wishes to replace the pair of wings in use by another pair, for example bacause of a chainge in weather conditions or to improve the flight efficiency or to produce a longer flying time, in the case of a glider form of model aircraft, in particular, it is only necessary for him to release the fixing device 4 and replace the wings by another pair of wings of the required other cross-sectional profile utilising always the corresponding intermediate member so that the most desirable connection to the fuselage 1 from the aerodynamic point of view is immediately guaranteed whatever the new wing format selected.

Figure 9:
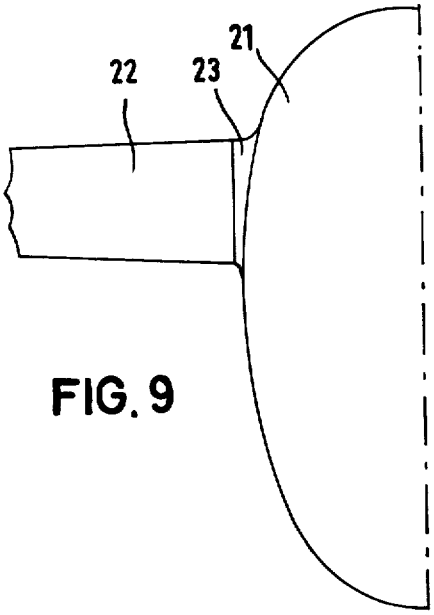
FIG. 9 shows diagrammatically in elevation, the connecting zone between a wing and a fuselage of a model plane, with the wing fitted directly on to the fuselage but replaceable in accordance with the present invention.

Referring next to FIG. 9, a fuselage 21 can be seen to be connected to a wing 22 by means of internally arranged fixing devices which are not shown. The joint is indicated at 23. With the size of the wing cross-section shown, no intermediate member need be provided between the wing 22 and the fuselage 21, since the connecting surface on the side of the fuselage (indicated at 24 in FIG. 11) corresponds to the cross-section of the wing 22.

Figure 10:
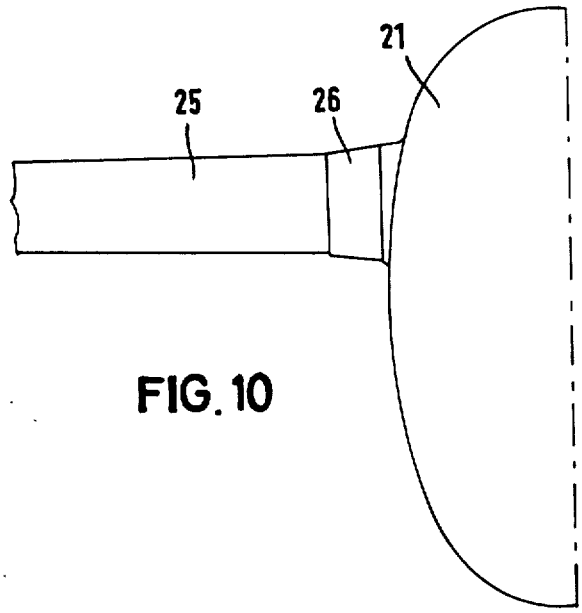
FIG. 10 is a view similar to that of FIG. 9 showing the use of an intermediate member between the wing and the fuselage enabling the wing shown in FIG. 9 to be replaced by a wing of alternative cross-section.

In contrast, FIG. 10 shows a similar view to that shown in FIG. 9, but in which an intermediate member needs to be emplaced between the wing and the side 24 of the fuselage to ensure that the required aerodymamically smooth transition between fuselage and wing is achieved. In this case, an intermediate member 26 is utilised between the fuselage 21 and a wing 25 of smaller cross-section than the wing 22 of FIG. 9, thereby providing an aerodynamically smooth transitional surface. It can be seen from FIG. 11 that the intermediate member 26 comprises recesses 27 and circular openings 28 for the passage of fixing means (not shown) between the wing 25 and the fuselage 21 and which can be of the type shown in FIG. 1. Corresponding openings or recesses 29 are indicated on the connecting surface 24 on the side of the fuselage.

Figure 11:
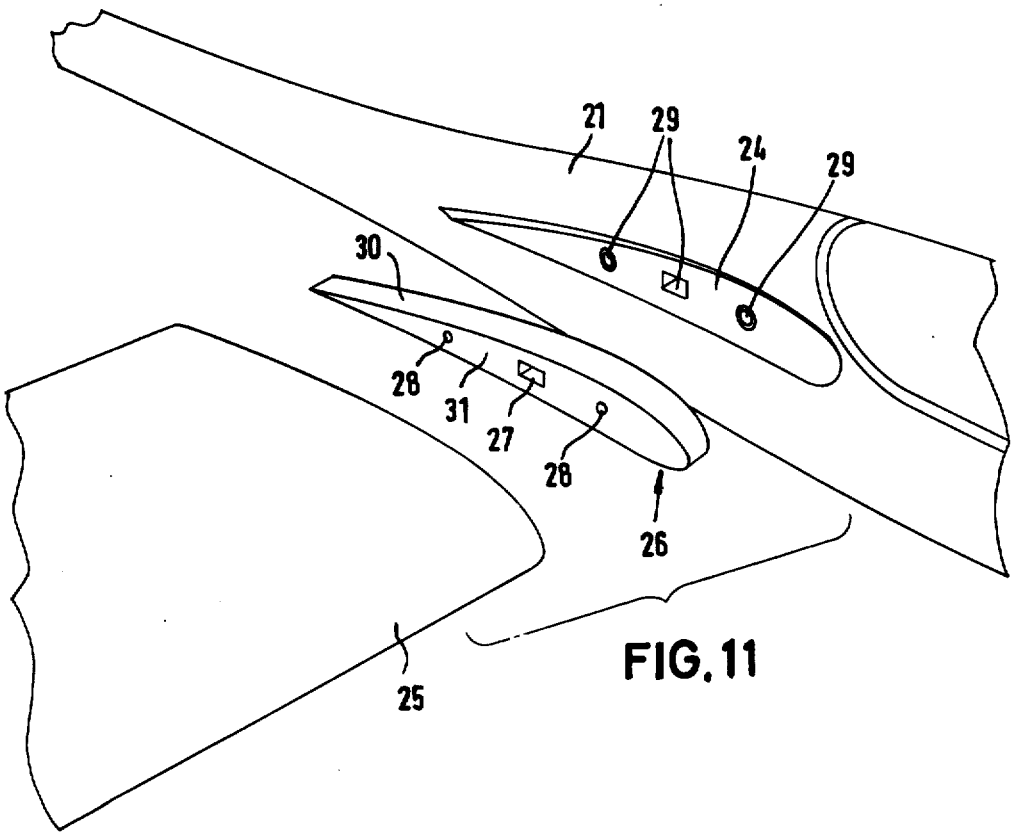
FIG. 11 is an exploded perspective view of the intermediate member between a fuselage and a wing, the latter being shown partly in section.

FIG. 11 also shows that the intermediate member 26 possesses a surface 30 of aerodynamically favourable form lying between the face 31 of the intermediate member on the wing side and the surface not visible on the fuselage side, which surface corresponds in its cross-section to the connecting surface 24 on the fuselage.

I claim:

1. A model aeroplane of the glider or motor-driven type which comprises, scaled down from the dimensions of a full size aeroplane, a fuselage, releasable fixing means, a pair of wings fitted laterally one on each side of the fuselage by said releasable fixing means, and an intermediate member intermediate the end of each wing which is adjacent the fuselage and the fuselage, said intermediate member having outer surfaces with contours providing an aerodynamically smooth transition from the fuselage to the wings, said intermediate member being defined on the side thereof adjacent the wing by an end surface corresponding in size and shape to the cross-sectional form of the wing and being defined on the side thereof adjacent the fuselage by an end surface corresponding in its contours to the contours of the fuselage, said intermediate members comprising: a stiffening strut structure, a skin over said stiffening strut structure, said stiffening strut structure having struts disposed with respect to each other so that said fixing means are passable through said intermediate members from the fuselage to the wings, said wings and intermediate members being interchangeably attachable to said fuselage by said fixing means passing through said intermediate member, said wings having a shape dependent on predetermined environmental characteristics, said intermediate members having all the same shape and size on the side of the fuselage and having different cross-sections on the other side adapted to different wing sections.

2. A model aeroplane according to claim 1, wherein said skin is formed of an elastomeric material, said intermediate members being pressed with substantially slight pretension against the fuselage by said fixing means.

3. A model aeroplane according to claim 1, wherein the fuselage has paired lateral surfaces having the shape of a wing cross-section, said intermediate members being formed as self-supporting bodies having an end surface corresponding to said lateral surfaces and adjacent said lateral surfaces and an end surface adjacent said wings and shaped in accordance with the cross-section of said wings, the cross-section of the said wings fitted laterally on the fuselage differing from the wing cross-section characteristic of said paired lateral surfaces.

4. A model aeroplane according to claim 3, wherein the intermediate members are formed as hollow bodies.

5. a model aeroplane according to claim 3, wherein the intermediate members are formed as hollow bodies of elastomeric material, said intermediate members are pressed with substantially slight pretension against the fuselage by said fixing means.

6. An assemblage of parts for use in the construction of model aeroplanes of the glider or motor-driven type, comprising, scaled down from the dimensions of the respective parts of a full size aeroplane:

a fuselage, a plurality of pairs of wings having different aerodynamic characteristics for fitting laterally one of a selected pair of wings on each side of said fuselage, releasable fixing means for fitting one pair of wings to said fuselage, and associated with each pair of wings, a pair of intermediate members for fitting intermediate the associated wings and the fuselage and having outer surfaces with contours providing aerodynamically smooth transition from the fuselage to the associated wings, the intermediate members being defined on the side thereof adjacent the wings, in use, by end surfaces corresponding in size and shape to the cross-section of the associated wings and being defined on the side thereof adjacent the fuselage, in use, by an end surface corresponding in its contours to the contours of the fuselage and is the same for each pair of intermediate members, said intermediate members comprising a stiffening strut structure, a skin over said stiffening strut structure, said stiffening strut structure having struts being disposed with respect to each other so that said fixing means are passable through the intermediate members from the fuselage to the wings.

7. An assemblage according to claim 6, wherein said skin is formed of an elastomeric material, said intermediate members being pressed, in use, with substantially slight pretension against the fuselage by said fixing means.

8. An assemblage as claimed in claim 6, wherein the fuselage has paired lateral surfaces with the shape of a wing cross-section, one pair of said wings having said wing cross-section and the intermediate members being associated with the remaining pairs of wings and having an end surface corresponding to said lateral surfaces and an end surface shaped in accordance with the cross-section of said wings.

9. An assemblage as claimed in claim 8, wherein the intermediate members are formed as hollow bodies.

10. An assemblage according to claim 8, wherein the intermediate members are formed as hollow bodies of elastomeric material, said intermediate members being pressed, in use, with substantially slight pretension against the fuselage by said fixing means.

11. A model aeroplane of the glider or motor-driven type which comprises, scaled down from the dimensions of a full size aeroplane, a fuselage, releasable fixing means, a pair of wings fitted laterally one on each side of the fuselage by said releasable fixing means, and an intermediate member intermediate the end of each wing which is adjacent the fuselage and the fuselage, said intermediate member having outer surfaces with contours providing an aerodynamically smooth transition from the fuselage to the wings, said intermediate member being defined on the side thereof adjacent the wing by an end surface corresponding in size and shape to the cross-sectional form of the wing and being defined on the side thereof adjacent the fuselage by an end surface corresponding in its contours to the contours of the fuselage, said intermediate members being formed as solid bodies and having recesses therethrough so that said fixing means are passable through said intermediate members from the fuselage to the wings, said wings and intermediate members being interchangeably attachable to said fuselage by said fixing means passing through said intermediate member, said wings, having a shape dependent on predetermined environmental characteristics, said intermediate members having all the same shape and size on the side of the fuselage and having different cross-sections on the other side adapted to different wing sections.

12. A model aeroplane according to claim 11, wherein the intermediate members are formed as solid bodies of elastomeric material, said intermediate members being pressed with substantially slight pretension against the fuselage by said fixing means.

13. An assemblage of parts for use in the construction of model aeroplanes of the glider or motor-driven type, comprising, scaled down from the dimensions of the respective parts of a full size aeroplane:

a fuselage, a plurality of pairs of wings having different aerodynamic characteristics for fitting laterally one of a selected pair of wings on each side of said fuselage, releasable fixing means for fitting one pair of wings to said fuselage, and associated with each pair of wings, a pair of intermediate members for fitting intermediate the associated wings and the fuselage and having outer surfaces with contours providing aerodynamically smooth transition from the fuselage to the associated wings, the intermediate members being defined on the side thereof adjacent the wings, the use, by end surfaces corresponding in size and shape to the cross-section of the associated wings and being defined on the side thereof adjacent the fuselage, in use, by an end surface corresponding in its contours to the contours of the fuselage and is the same for each pair of intermediate members, said intermediate members being formed as solid bodies and having recesses therethrough so that said fixing means are passable through the intermediate members from the fuselage on the wings.

14. An assemblage as claimed in claim 13, wherein the intermediate members are formed as solid bodies of elastomeric material, said intermediate members being pressed, in use, with substantially slight pretension against the fuselage by said fixing means.

* * * * *